US008957571B2

(12) United States Patent
Riskin

(10) Patent No.: US 8,957,571 B2
(45) Date of Patent: Feb. 17, 2015

(54) IONIZING ELECTRODE WITH INTEGRAL CLEANING MECHANISM

(71) Applicant: Yefim Riskin, Katzrin (IL)

(72) Inventor: Yefim Riskin, Katzrin (IL)

(73) Assignee: Filt Air Ltd. (IL)

( * ) Notice: Subject to any disclaimer, the term of this patent is extended or adjusted under 35 U.S.C. 154(b) by 72 days.

(21) Appl. No.: 13/938,566

(22) Filed: Jul. 10, 2013

(65) Prior Publication Data

US 2015/0015135 A1 Jan. 15, 2015

(51) Int. Cl.
*H01J 1/50* (2006.01)
*H01J 27/26* (2006.01)

(52) U.S. Cl.
CPC ..... *H01J 27/26* (2013.01)
USPC ..... 313/156; 313/120; 313/125

(58) Field of Classification Search
CPC ..... F01L 9/04; F02B 3/06; F02M 25/0836
USPC ..... 313/156, 120, 125
See application file for complete search history.

(56) References Cited

U.S. PATENT DOCUMENTS 4,482,094 A * 11/1984 Knape ..... 239/88
5,768,087 A 6/1998 Vernitskiy

FOREIGN PATENT DOCUMENTS

JP 2006011540 1/2006
WO 2013021378 2/2013

OTHER PUBLICATIONS

International Search Report dated Nov. 29, 2012 corresponding to PCT/IL2012/000296.

* cited by examiner

*Primary Examiner* — Vip Patel
(74) *Attorney, Agent, or Firm* — Niels Haun; Dann Dorfman Herrell & Skillman, PC

(57) ABSTRACT

Ionizing electrode with a cleaning mechanism including a solenoid with a bushing, a magnetic conductor, a coil housing a core having first and second ends, a return spring and a terminal for high voltage supply mounted on its body. The ionizing electrode is mounted inside the bushing and is configured so that an ionizing end and a non-ionizing end of the electrode protrude from the bushing, the non-ionizing end being fastened to the first end of the solenoid core.

6 Claims, 1 Drawing Sheet

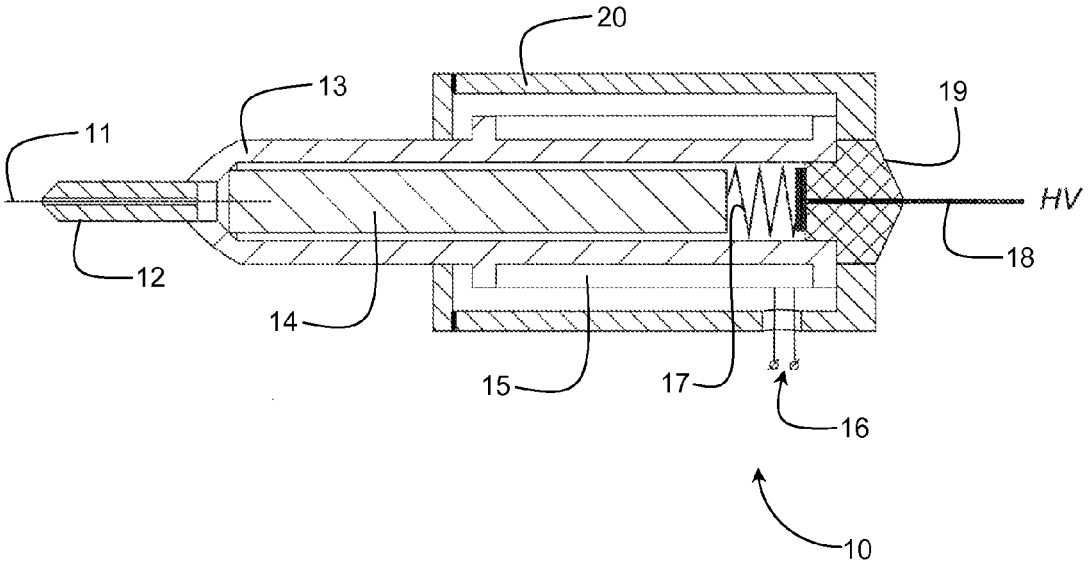
20
13
19
11
HV
12
18
14
15
17
16
10

IONIZING ELECTRODE WITH INTEGRAL CLEANING MECHANISM

FIELD OF THE INVENTION

This invention relates to ionizing electrode with a cleaning mechanism is designed for the use in ion generators.

BACKGROUND OF THE INVENTION

Ionizing electrodes with a dust cleaning mechanism are known and described, for example, in U.S. Pat. Nos. 5,768,087 and 7,969,707, WO 2009/151856 and US 2010/0188793.

In these prior art publications, either centrifugal force is used as an energy source for the cleaning process, or devices are employed that convert linear movement to a rotational movement, or rotational movement to linear movement. The ionizing electrodes are formed as needles or as thin wires.

U.S. Pat. No. 7,408,759 discloses devices for cleaning wire electrodes where the electrode is passed through a bushing. A drawback of this device is the low degree of cleaning, the reason being that because of the need to facilitate the wire sliding inside the bushing during nonlinear back-and-forth motion, the inner diameter of the bushing is made much larger than the wire diameter, and the length of the bushing is many times smaller than the maximum amplitude of back-and-forth motion of the wire. For these reasons only a part of the wire circumference is cleaned.

A common drawback of the all above mentioned devices is their complexity.

SUMMARY OF THE INVENTION

An aim of the present invention is to eliminate the drawbacks of existing devices.

In the proposed invention an ionizing electrode is formed as a thin wire made from a conducting spring material. The electrode is mounted inside a fixed bushing with the ionizing and non-ionizing ends of the electrode protruding from the bushing. During cleaning of the ionizing end from dust the electrode travels inside the bushing owing to the linear back-and-forth movements. The movements are generated by a solenoid which consists of a body made from insulating material, a magnetic conductor and a coil with a core and a return spring located inside it.

Additionally, a high voltage supply terminal is located inside the coil, the return spring being placed between the terminal and one of the core ends, while the non-ionizing end of the electrode protruding from the bushing is fixed at the other end of the core.

BRIEF DESCRIPTION OF THE DRAWINGS

In order to understand the invention and to see how it may be carried out in practice, embodiments will now be described, by way of non-limiting example only, with reference to the accompanying drawings, in which:

FIG. 1 is a cross-sectional view of a device having an ionizing electrode with a cleaning mechanism according to an embodiment of the invention.

DETAILED DESCRIPTION OF EMBODIMENTS

FIG. 1 illustrates the construction of a device 10 according to the invention comprising an ionizing electrode 11, a bushing 12, a solenoid body 13, a solenoid core 14, a solenoid coil 15, terminals 16 for coupling a voltage supply to the coil 15, a return spring 17, a high voltage supply terminal 18, an insulator 19 and a magnetic conductor 20.

The ionizing electrode 11 is mounted inside the bushing 12 which in turn is mounted on the solenoid body 13. The coil 15 and the terminals 16, the insulator 19 and the magnetic conductor 20 are mounted on the solenoid body 13.

The coil 15 accommodates therein the core 14, the return spring 17 and the high voltage supply terminal 18.

The non-ionizing end of the ionizing electrode 11 is fastened to one end of the core 14 and the return spring 17 is positioned between the high voltage supply terminal 18 and the other end of the core 14. The ionizing end of the ionizing electrode 11 projects out of the bushing 12. In the normal operation mode of the device, high voltage is applied through the high voltage supply terminal 18, and is fed via the return spring 17 and the core 14 to the ionizing electrode 11 thus generating ions on the ionizing end thereof.

The high voltage supply terminal 18 is insulated from the coil 15 and the magnetic conductor 20 by the insulator 19.

Since the coil 15 is mounted on the solenoid body 13 which houses the core 14 across which the high voltage is applied, the breakdown voltage of the material from which the solenoid body 13 is formed and which is mounted between the coil 15 and the core 14 should be higher than the magnitude of the high voltage applied to the high voltage supply terminal 18.

The procedure for cleaning the ionizing end of electrode 11 from dust is as follows.

A voltage pulse is applied to the coil 15 via the terminals 16, thereby generating a magnetic field in the magnetic conductor 20, which draws the core 14 into the coil 15. As a result, the return spring 17 contracts, the ionizing end of the ionizing electrode 11 enters the bushing 12 and the dust settled on the ionizing electrode 11 is accumulated on the end of the bushing 12.

For efficient cleaning of the ionizing electrode 11, its cross-section should be identical to the inner cross-section of the bushing 12. Moreover, the outer diameter of the ionizing electrode 11 and the inner diameter of the bushing 12 are selected to be as close as possible. In an embodiment of the invention reduced to practice, when the inner diameter of the opening in the bushing 12 is equal to 110 μm, the diameter of the ionizing electrode 11 is set to 100 μm. Hence, the gap is equal to 5 μm, which ensures a high quality of cleaning. In the proposed embodiment there is a relation between the maximum amplitude of the back-and-forth movement of the solenoid core 14 and the length of the ionizing end of the ionizing electrode 11 protruding from the bushing 12. Likewise, there is a relation between the maximum amplitude of the back-and-forth movement of the core 14 and the length of the bushing 12.

These relations are as follows: in order for the ionizing end of the ionizing electrode 11 to enter into the bushing 12 during the cleaning process, the length of the end should be smaller than the maximum amplitude of the back-and-forth movement of the solenoid core 14.

At the same time, the ionizing end of the ionizing electrode 11 is being gradually shortened as a result of the metal emission during ion generation. Consequently, as the ionizing electrode 11 is drawn into the bushing 12, if the maximum amplitude of the stroke relative to the length of the bushing 12 is too large, the outermost ionizing end of the electrode 11 will be fully drawn into the busing 12 and will be extracted therefrom by the solenoid core 14 as it moves away from the bushing 12. This must not be allowed to happen since, owing to the very small radial clearance between the ionizing electrode 11 and the bushing 12, it is hardly possible for the ionizing electrode 11 to re-enter the bushing 12 during the reverse motion of the solenoid core 14 once it has escaped therefrom. Therefore the length of the bushing should be larger than the maximum amplitude of the back-and-forth movement of the solenoid core 14.

Tests show that in order to clean the bushing 12 from the accumulated dust that settles thereon, a series of short pulses should be applied to the solenoid coil 15. The pulses generate an effect of mechanical shocks owing to the return spring 17, which results in shaking off the clumps of dust from the edge of the bushing 12.

The invention claimed is:

1. Ionizing electrode with a cleaning mechanism which comprises:

a solenoid with a bushing, a magnetic conductor, a coil housing a core having first and second ends, a return spring and a terminal for high voltage supply mounted on its body; and an ionizing electrode mounted inside the bushing and configured so that an ionizing end and a non-ionizing end of the electrode protrude from the bushing, the non-ionizing end of the electrode being fastened to the first end of the solenoid core.

2. The ionizing electrode according to claim 1 wherein the return spring is located between the terminal for high voltage supply and the second end of the solenoid core.

3. The ionizing electrode according to claim 1 where the terminal for high voltage supply is connected to the ionizing electrode via the return spring and the solenoid core.

4. Ionizing electrode with a cleaning mechanism which comprises:

a solenoid with a bushing, a magnetic conductor, a coil housing a core having first and second ends, a return spring and a terminal for high voltage supply mounted on its body; and an ionizing electrode mounted inside the bushing and configured so that an ionizing edge and a non-ionizing end of the electrode protrude from the bushing, and wherein a length of the ionizing edge of the electrode protruding from the bushing is smaller than a maximum amplitude of back-and-forth motion of the solenoid core.

5. The ionizing electrode according to claim 4 wherein the length of the bushing is bigger than the maximum amplitude of back-and-forth motion of the solenoid core.

6. The ionizing electrode according to claim 4 wherein the cleaning of the ionizing edge of the electrode takes place during application of a series of voltage pulses to the solenoid core.

* * * * *